US007403724B2

(12) United States Patent
Yamaguchi

(10) Patent No.: US 7,403,724 B2
(45) Date of Patent: Jul. 22, 2008

(54) IMAGE FORMING APPARATUS

(75) Inventor: Yasunaga Yamaguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 184 days.

(21) Appl. No.: 11/333,402

(22) Filed: Jan. 18, 2006

(65) Prior Publication Data

US 2006/0158479 A1 Jul. 20, 2006

(30) Foreign Application Priority Data

Jan. 18, 2005 (JP) ..... 2005-009756

(51) Int. Cl.
*G03G 15/08* (2006.01)

(52) U.S. Cl. ..... 399/27

(58) Field of Classification Search ..... 399/15, 399/27, 30, 43, 44, 45, 58, 60; 347/19, 140
See application file for complete search history.

(56) References Cited

U.S. PATENT DOCUMENTS

| | | | | |
|---|---|---|---|---|
| 5,708,917 | A | 1/1998 | Kawai et al. | |
| 5,724,627 | A * | 3/1998 | Okuno et al. | 399/27 |
| 6,819,884 | B1 * | 11/2004 | Carter et al. | 399/27 |
| 2001/0043259 | A1 * | 11/2001 | Ogata | 347/140 |
| 2004/0247330 | A1 | 12/2004 | Kin | |

FOREIGN PATENT DOCUMENTS

| | | |
|---|---|---|
| EP | 0587172 A1 | 3/1994 |
| EP | 1553464 A2 | 7/2005 |
| JP | 2002-283675 | 10/2002 |

* cited by examiner

*Primary Examiner*—Sandra L Brase
(74) *Attorney, Agent, or Firm*—Rabin & Berdo, PC

(57) ABSTRACT

An image forming apparatus capable of settling such problem as an error between a cumulative developer consumption calculated on the basis of image information inputted into a exposing device and an actual developer consumption, which occurred due to fog. The image forming apparatus changes inputted image information into binary image information, exposes photosensitive body on the basis of the binary image information, forms a developer image on record medium, and comprises an exposure picture element number counting section for counting picture element number of exposed picture elements in all picture elements to constitute the binary image information; a print condition detecting section for detecting appointed print condition; a revision information storing section for storing revision information on the basis of the print condition; and a developer quantity calculating section for calculating a developer consumption on the basis of the picture element number counted by the exposure picture element number counting section, the print condition detected by the print condition detecting section, and the revision information stored in the revision information storing section.

18 Claims, 8 Drawing Sheets

IMAGE FORMING APPARATUS

BACKGROUND OF THE INVENTION

1. Field of the Invention

The invention relates to an image forming apparatus such as printer or the like.

2. Related Background Art

An image forming apparatus with electrophotography is formed from an image carrying body which is formed in a developing device and is used to form an electrostatic latent image; a transferring roller which is placed to face to the image carrying body and is supplied a transfer voltage by a voltage supplying section; a transferring belt which is made out of member having a definite electrical resistance and is used to convey record medium; a driving section for transferring device to drive the transferring belt; and a fixing device which is used to fix developer onto the record medium conveyed by the transferring belt.

When the image forming apparatus received image information from outside, the image forming apparatus makes the surface of the image carrying body be on charge; forms an electrostatic latent image on the surface of the image carrying body by an exposing device based on the image information; forms a developer image on the image carrying body on which the electrostatic latent image is formed by supplying developer such as toner filled in a cartridge to the image carrying body formed in developing device; transfers the developer image onto record medium by using the image carrying body and the transferring roller; and forms an image onto the record medium by making the fixing device to fix transferred developer.

In such image forming apparatus, while forming the developer image on the image carrying body, a remainder quantity of the developer is calculated by measuring a consumption of consumed developer. Such technology is disclosed by patent document 1.

Patent document 1: Japan patent publication 2002-283675.

In the patent document 1, in the concrete, picture element number to constitute the image information inputted into the exposing device is counted; a unit quantity of the consumed developer for one picture element is previously set; a developer consumption is calculated by using a proportional relation between the unit quantity per picture element and the picture element number to constitute the image information; and the developer consumption is recorded cumulatively. A difference between a developer initial quantity accommodated in an unused cartridge and the developer consumption cumulatively recorded serves as a remainder quantity of the developer in the cartridge.

However, with long time use, the electrical characteristic of the surface of the image carrying body falls, and the electric potential distribution in neighborhood of border between exposure portion and un-exposure portion on the surface of the image carrying body is not steep but becomes some flat. Therefore, while developing image, a phenomenon called fog happened, that is, a trace of the developer sticks to the portion on which image should not be formed. On the contrary, another phenomenon also happened, that is, the developer does not stick to the portion on which image should be formed. When such phenomenon happens, the proportional relation between the unit quantity per picture element and the picture element number to constitute the image information is not valid, an error happens between the cumulative developer consumption calculated on the basis of the image information inputted into the exposing device and the actual developer consumption. If such phenomenon often happens, the error will enlarge.

SUMMARY OF THE INVENTION

It is, therefore, an object of the invention to provide an image forming apparatus capable of reducing the error between the cumulative developer consumption calculated and the actual developer consumption, and of calculating a correct remainder quantity of the developer.

According to the present invention, there is provided an image forming apparatus which changes inputted image information into binary image information, exposes photosensitive body on the basis of the binary image information, and forms a developer image on record medium, comprising:

an exposure picture element number counting section for counting picture element number of exposed picture elements in all picture elements to constitute the binary image information;

a print condition detecting section for detecting appointed print condition;

a revision information storing section for storing revision information on the basis of the print condition; and a developer quantity calculating section for calculating a developer consumption on the basis of the picture element number counted by the exposure picture element number counting section, the print condition detected by the print condition detecting section, and the revision information stored in the revision information storing section.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

Figure 1:
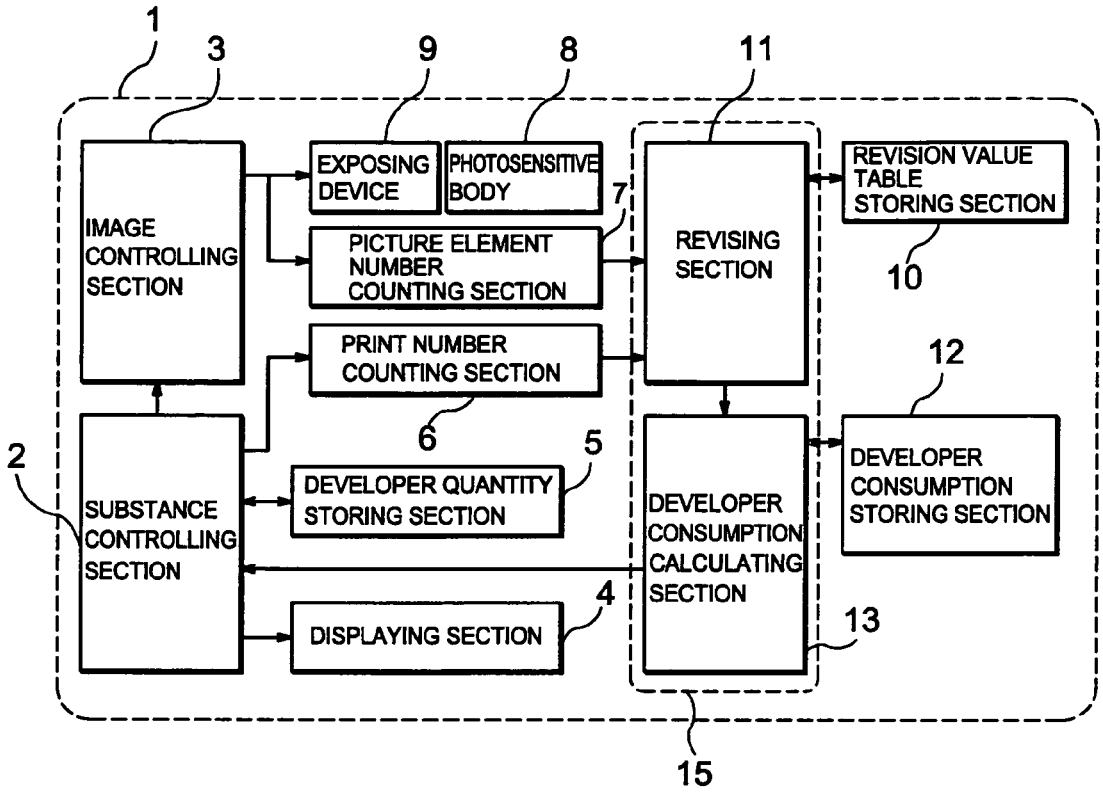
FIG. 1 is a block diagram showing construction of an image forming apparatus according to the embodiment 1.
Figure 2:
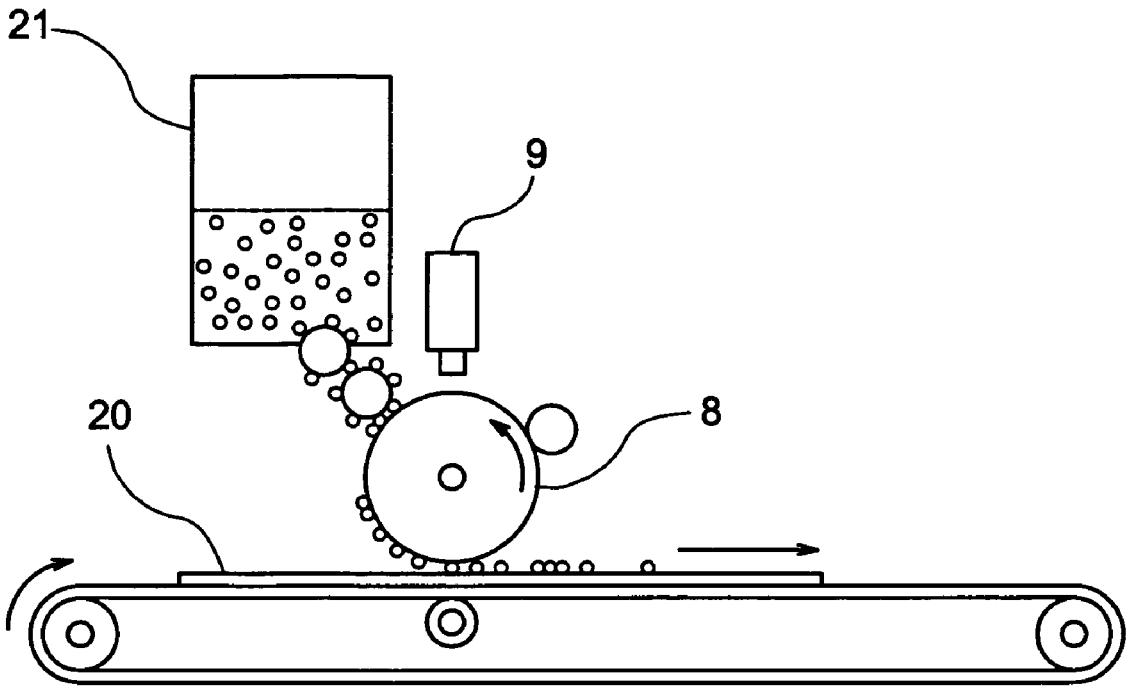
FIG. 2 is a front diagram showing general view of an image forming system in the embodiment.

FIG. 1 is a block diagram showing construction of an image forming apparatus according to the embodiment 1; and FIG. 2 is a front diagram showing general view of an image forming system in the embodiment.

In the embodiment 1, image forming apparatus 1 is formed from a substance controlling section 2 to receive image information from outside; an image controlling section 3 to change the image information received from the substance controlling section 2 into binary image information; a displaying section 4 to inform user of a developer remainder quantity by displaying the developer remainder quantity; a developer quantity storing section 5 to record a developer quantity; a print number counting section 6 which serves as a print condition detecting section to add up the number of sheet 20 as record medium on which image is formed by the image forming apparatus 1; a picture element number counting section 7 which serves as an exposed picture element number counting section to calculate the exposed picture element number of the binary image information; a photosensitive body 8 to make developer stick onto the sheet 20; an exposing device 9 to form an electrostatic latent image by exposing the surface of the photosensitive body 8; a revision value table storing section 10 which serves as a revision information memorizing section to memorize revision information calculated by a method stated below; a revising section 11 which is a part of a developer quantity calculating section 15 and is used to refer to the revision information on the basis of the number of sheet 20 added up in the print number counting section 6 and on the basis of the exposed picture element number of the binary image information calculated in the picture element number counting section 7; a developer consumption storing section 12 to store a developer unit consumption needed for forming one picture element as a unit on the sheet 20; a developer consumption calculating section 13 which is a part of the developer quantity calculating section 15 and is used to calculate a developer consumption on the basis of the revision information in the revising section 11 and on the basis of the developer unit consumption needed for forming one picture element in the developer consumption storing section 12; and a cartridge 21 to accommodate the developer as a developer accommodating body. The developer quantity calculating section 15 has the revising section 11 and the developer consumption calculating section 13.

The substance controlling section 2 sends the image information received from outside to the image controlling section 3, sends print number information to the print number counting section 6 per sheet, and presents a developer remainder quantity to user via the displaying section 4 on the basis of the developer consumption received from the developer consumption calculating section 13 and the developer quantity stored in the developer quantity storing section 5. The print number counting section 6 having received the print number information cumulatively counts the print number by itself, and sends the counted print number to the revising section 11.

The image controlling section 3 changes the image information received from the substance controlling section 2 into the binary image information, and sends the binary image information to the exposing device 9 and the picture element number counting section 7. The exposing device 9 having received the binary image information forms an electrostatic latent image on the surface of the photosensitive body 8 on the basis of the received binary image information. Further, the picture element number counting section 7 having received the binary image information calculates the picture element number in the received binary image information and exposed by the exposing device 9, and informs the revising section 11 of the picture element number.

The revising section 11, after received the print number from the print number counting section 6 and was informed of the picture element number by the picture element number counting section 7, on the basis of these information, refers to a revision value table stored in the revision value table storing section 10, and sends the revision information obtained by referring to the developer consumption calculating section 13. Further, the developer consumption calculating section 13 having received the revision information refers to the developer unit consumption stored in the developer consumption storing section 12, calculates the developer consumption, and sends the developer consumption to the substance controlling section 2.

Figure 3:
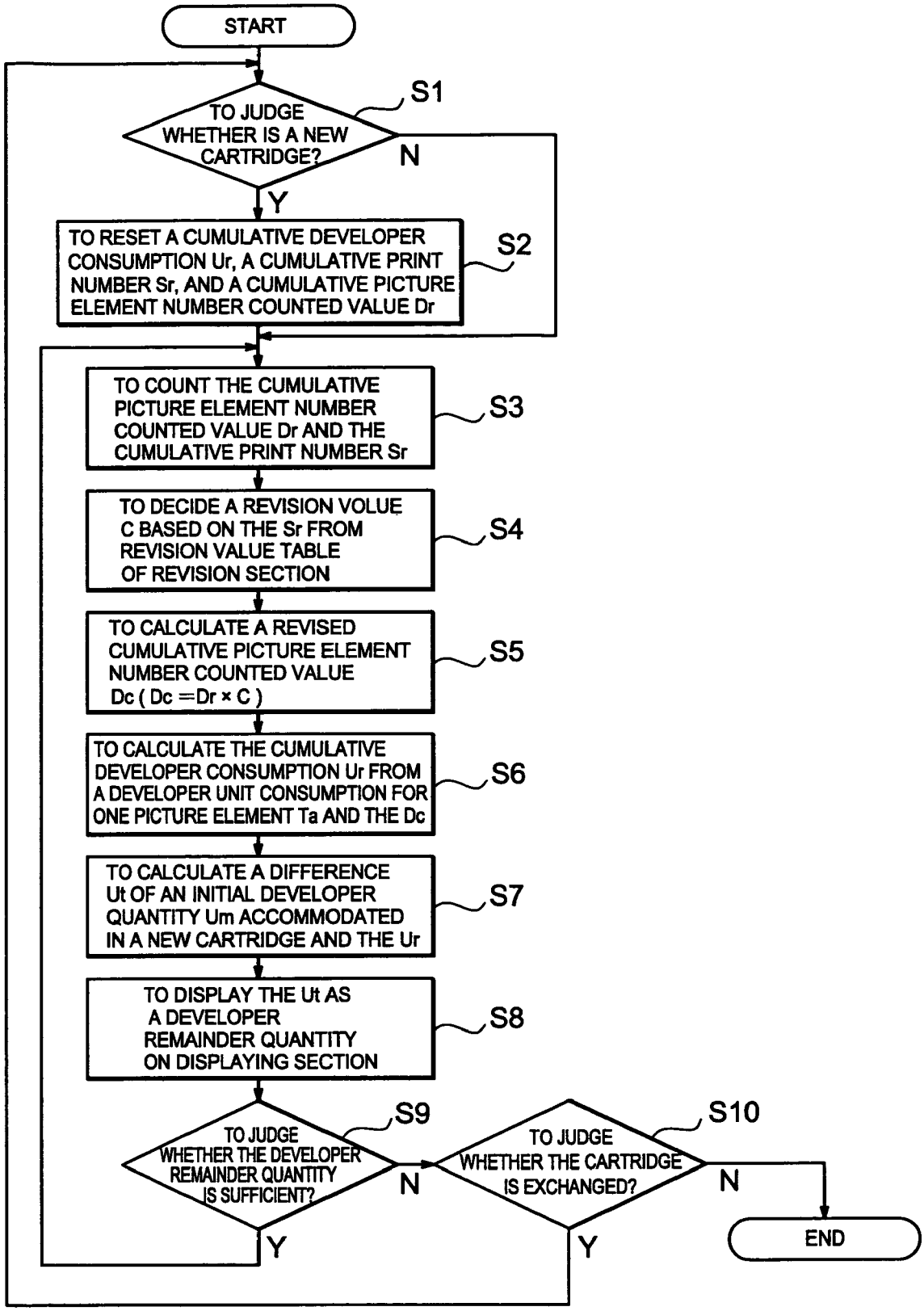
FIG. 3 is a flowchart showing the operation of the image forming apparatus in the embodiment 1 for calculating developer consumption.

FIG. 3 is a flowchart showing the operation of the image forming apparatus in the embodiment 1 for calculating developer consumption. The image forming apparatus 1 calculates the developer consumption according to the flow chart showed by FIG. 3.

In the case that the substance controlling section 2 receives the image information from an external apparatus, in step 1, the substance controlling section 2 judges whether the cartridge 21 is unused.

If the cartridge 21 is unused, in step 2, the substance controlling section 2 resets a cumulative developer consumption Ur had by itself to an initial value; sends a command to reset a cumulative print number Sr to an initial value with respect to the print number counting section 6; and sends a command to reset a cumulative picture element number counted value Dr to an initial value with respect to the picture element number counting section 7 via the image controlling section 3.

Further, if the cartridge 21 is judged to be not unused in the step 1, the substance controlling section 2 does not reset the cumulative developer consumption Ur had by itself to an initial value, does not send a command to reset a cumulative print number Sr to an initial value with respect to the print number counting section 6, and does not send a command to reset a cumulative picture element number counted value Dr to an initial value with respect to the picture element number counting section 7 via the image controlling section 3, but sends the image information of an image formed on the sheet 20 to the image controlling section 3.

The image controlling section 3 having received the image information changes the image information into binary image information, and sends the binary image information to the exposing device 9 and the picture element number counting section 7.

Moreover, the cumulative developer consumption Ur indicates a quantity of developer consumed from the cartridge 21 is exchanged into new to current stage; the cumulative print number Sr is a value obtained by cumulatively added up the number of the sheet on which image is formed, from the cartridge 21 is exchanged into new to current stage; and the cumulative picture element number counted value Dr is a value obtained by cumulatively added up the picture element number formed on the sheet from the cartridge 21 is exchanged into new to current stage.

Then, in step 3, the picture element number counting section 7 calculates picture element number Do from the binary image information, and counts into the cumulative picture element number counted value Dr. Further, the print number counting section 6 counts the cumulative print number Sr based on the number of the sheet requested in the image information.

As stated above, the picture element number counting section 7 calculates the picture element number Do whenever receiving the image information from the image controlling section 3, and the image information Do is added up as the printed cumulative picture element number counted value Dr from beginning to use the new cartridge 21; the print number counting section 6 calculates a print number So whenever receiving the image information from the image controlling section 3, and the print number So is added up as the cumulative print number Sr from beginning to use the new cartridge 21.

Further, in step 4, the revising section 11 decides a revision coefficient C based on the cumulative print number Sr from the revision value table stored in the revision value table storing section 10.

Next is to explain a deciding method of the revision coefficient C in detail.

Figure 4:
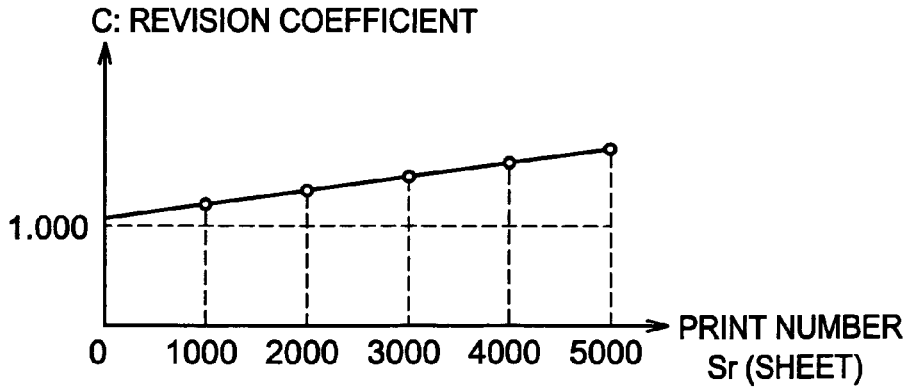
FIG. 4 is a relation diagram showing a relation between revision coefficient C and cumulative print number Sr.

FIG. 4 is a relation diagram showing a relation between revision coefficient C and cumulative print number Sr. FIG. 4 is plotted by measuring the cumulative picture element number counted value Dr, a developer unit consumption Ta and the cumulative developer consumption Ur while using the image forming apparatus 1 to respectively form image on 1000 sheets, 2000 sheets, 3000 sheets, 4000 sheets and 5000 sheets and by applying these measured values to an expression 1.

$$C=Ur\div(Ta\times Dr) \qquad \text{Expression 1}$$

The developer unit consumption Ta indicates a consumption quantity of the developer used for printing one picture element.

TABLE 1

| Print Number Sr (Sheet) | Revision coefficient C |
|---|---|
| 0~500 | 1.000 |
| 501~1000 | 1.010 |
| 1001~1500 | 1.020 |
| 1501~2000 | 1.040 |
| 2001~2500 | 1.060 |
| 2501~3000 | 1.070 |
| 3001~3500 | 1.080 |
| 3501~4000 | 1.100 |
| 4001~4500 | 1.110 |
| 4501~5000 | 1.120 |

As shown by FIG. 4, in fact, through measuring the cumulative developer consumption Ur used for printing to correspond to the cumulative picture element number counted value Dr, and through measuring the relation between the print number and the developer use quantity, the revision coefficient C can be thought it has a monotonous increasing tendency.

That is, through previously storing the table 1 made on the basis of the graph in FIG. 4 into the revision value table storing section 10 at manufacturing stage of the image forming apparatus 1 as revision information, the revising section 11 can refer to the revision value table stored in the revision value table storing section 10 on the basis of the cumulative print number Sr outputted from the print number counting section 6, and can decide the revision coefficient C.

Further, in step 5, in the revising section 11, a revision picture element number counted value Dc is decided by using the revision coefficient C decided by the revising section 11 and the cumulative picture element number counted value Dr received from the picture element number counting section 7 and by applying these used values to an expression 2, and it is sent to the developer consumption calculating section 13.

$$Dc=C\times Dr \qquad \text{Expression 2}$$

The revision picture element number counted value Dc is a picture element number counted value obtained by revising the cumulative picture element number counted value Dr based on the revision coefficient C.

In the case to use an approximate revision expression to indicate the relation of the revision coefficient C and the cumulative print number Sr, it is possible to not use the revision value table such as the table 1, but to use an approximate revision expression in the revising section 11 to revise the picture element number counted value Dc.

In the developer consumption storing section 12, the developer unit consumption Ta is previously stored from the manufacturing stage of the image forming apparatus 1, in step 6, the developer consumption calculating section 13 refers to the developer unit consumption Ta stored in the developer consumption storing section 12, and decides the cumulative developer consumption Ur according to an expression 3

$$Ur=Dc\times Ta \qquad \text{Expression 3}$$

The cumulative developer consumption Ur decided in the developer consumption calculating section 13 is sent to the substance controlling section 2. In the developer quantity storing section 5, a developer quantity Um previously accommodated in a new cartridge is recorded as an initial developer quantity. In step 7, the substance controlling section 2 having received the cumulative developer consumption Ur refers to the initial developer quantity Um and decides a developer remainder quantity Ut according to an expression 4.

$$Ut=Um-Ur \qquad \text{Expression 4}$$

The developer remainder quantity Ut is a remainder quantity of the developer that is remained in the cartridge 21 and is calculated in the substance controlling section 2 as a developer remainder quantity calculating section from the difference between the initial developer quantity Um previously accommodated in a new cartridge and the cumulative developer consumption Ur calculated by the developer consumption calculating section 13.

The developer remainder quantity Ut calculated by using the expression 4 is displayed by the displaying section 4 serving as an informing section and is informed to user. Moreover, as a informing method to user, it may be to display a ratio of the calculated developer remainder quantity Ut and the initial developer quantity Um previously accommodated in the new cartridge.

In step 9, the informed user or the image forming apparatus 1 judges whether the developer remainder quantity Ut is sufficient for forming next image when next image information is sent to the image forming apparatus 1. When the developer remainder quantity Ut is judged to be sufficient, the image forming apparatus 1 returns to the step 3, and again executes print. Further, in step 9, when the developer remainder quantity Ut is judged to not be sufficient, the image forming apparatus 1 informs user of an instruction needing to exchange the cartridge 21 into a new cartridge via the displaying section 4.

In the case, as an informing section being conveying means to convey the developer remainder quantity Ut to user, it may be to print the developer remainder quantity Ut on sheet, and it also may be to display the developer remainder quantity Ut on a information terminal connected with the image forming apparatus 1. For example, it may be to display a ratio of the calculated developer remainder quantity Ut and the initial developer quantity Um previously accommodated in the new cartridge on a displaying means such as a displayer of the information terminal to inform user.

In step 10, when the cartridge 21 is judged to be exchanged into a new cartridge by user, the image forming apparatus 1 returns to the step 1, executes print once more. At that time, in the step 1, because the cartridge 21 is a new cartridge, in the step 2, the cumulative developer consumption Ur, the cumulative print number Sr and the cumulative picture element number counted value Dr are respectively reset to initial values. That is, they are reset whenever the cartridge 21 is exchanged into a new cartridge. Further, in the step 10, if the cartridge 21 is not exchanged, the image forming apparatus 1 finishes the series of processes.

Moreover, after a toner remainder quantity sensor (not shown) detects that the remainder quantity of the cartridge 21 is less than a predetermined value, if the toner remainder quantity sensor further detects that the remainder quantity of the cartridge 21 is more than the predetermined value, the substance controlling section 2 can judge that the cartridge 21 is exchanged.

In the embodiment, the error produced due to the fog is considered, and the cumulative picture element number counted value Dr is revised. However, if because of other reason except the fog, the developer consumption can not be calculated from picture element number in image information, in this case, it is possible to execute a revision with respect to the relation of the cumulative picture element number counted value Dr and the developer unit consumption Ta, and to calculate a correct consumption of the developer.

Further, in the embodiment, the image forming apparatus 1 in which only one photosensitive body 8 and only one exposing device 9 are included is explained in detail. However, with respect to such image forming apparatus comprising plural kinds of developers such as cyan developer, magenta developer, yellow developer and black developer, the picture element number counting section 7 may execute counts of the respective picture element numbers to correspond to the respective developers by using the above-stated method, the revising section 11 may execute revisions to correspond to the respective developers by using the above-stated method, and the developer consumption calculating section 13 may execute calculations of the respective developer remainder quantities Ut to correspond to the respective developers by using the above-stated method.

Further, in the embodiment, the cumulative developer consumption Ur calculated by the developer consumption calculating section 13 is sent to the substance controlling section 2, the developer consumption is cumulatively recorded by the substance controlling section 2, and the developer remainder quantity Ut is calculated in the substance controlling section 2. However, it is possible to provide the cartridge 21 with a memorizing means such as memory element and the like, and to make the memorizing means memorize the cumulative developer consumption Ur as the developer consumption calculated by the developer consumption calculating section 13. Thus, the substance controlling section 2 may refer to the memorizing means to display the developer remainder quantity Ut on the displaying section 4.

In the embodiment, the image forming apparatus 1 changes the received image information into the binary image information, refers to the revision value table previously stored in the revision value table storing section 10 from the relation of the picture element number based on the binary image information and the print number, and revise the developer consumption by using the appointed calculating method. Therefore, it is possible to improve the accuracy of the developer consumption and the developer remainder quantity.

Embodiment 2

The following is to explain embodiment 2 in detail with respect to the image forming apparatus of the present invention. The image forming apparatus of the embodiment 2 has the same structure with respect to the photosensitive body 8, the exposing device 9, the cartridge 21 in the image forming apparatus 1 of the embodiment 1, therefore their detail explanations will be omitted.

Figure 5:
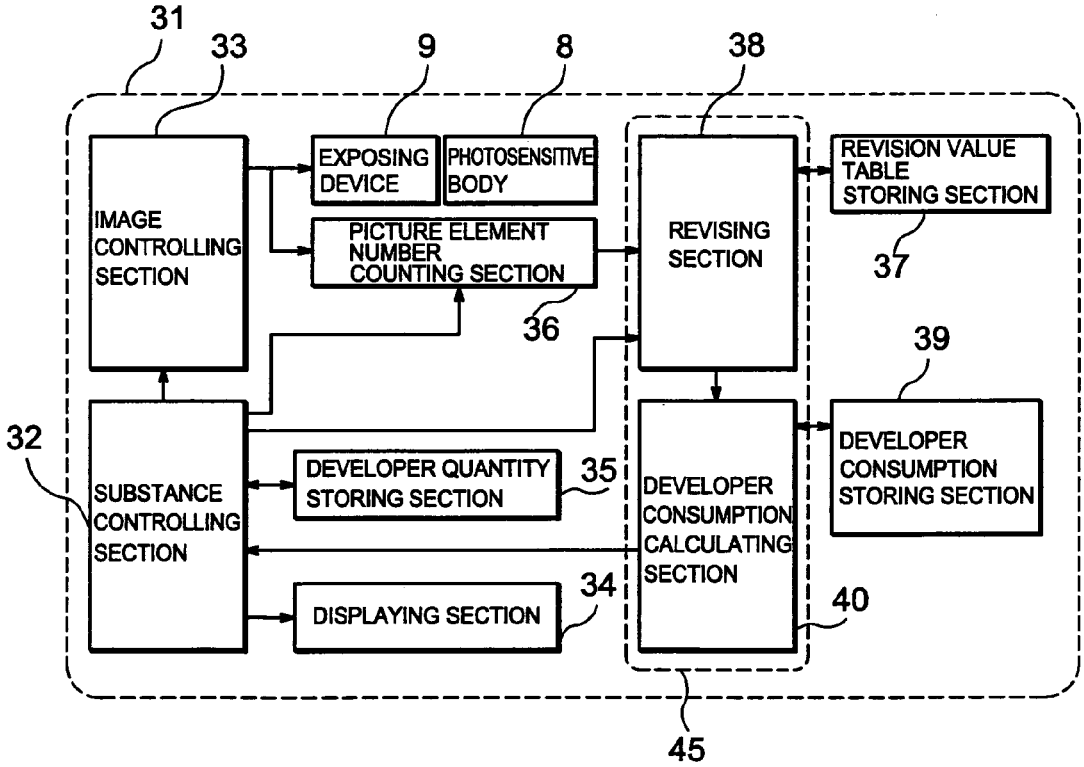
FIG. 5 is a block diagram showing construction of an image forming apparatus according to the embodiment 2.

FIG. 5 is a block diagram showing construction of an image forming apparatus according to the embodiment 2.

In the embodiment 2, image forming apparatus 31 is formed from a substance controlling section 32 to receive image information from outside; an image controlling section 33 to change the image information received from the substance controlling section 2 into binary image information; a displaying section 34 to inform user of a developer remainder quantity by displaying the developer remainder quantity; a developer quantity storing section 35 to record a developer quantity; a picture element number counting section 36 which serves as an exposed picture element number counting section to calculate the exposed picture element number of the binary image information; a photosensitive body 8 to make developer stick onto the sheet 20; an exposing device 9 to form an electrostatic latent image by exposing the surface of the photosensitive body 8; a revision value table storing section 37 which serves as a revision information memorizing section to memorize revision information calculated by a method stated below; a revising section 38 which is a part of a developer quantity calculating section 45 and is used to refer to the revision information on the basis of the exposed picture element number of the binary image information calculated in the picture element number counting section 36; a developer consumption storing section 39 to store a developer unit consumption needed for forming one picture element as a unit on the sheet 20; a developer consumption calculating section 40 which is a part of the developer quantity calculating section 45 and is used to calculate a developer consumption on the basis of the revision information in the revising section 38 and on the basis of the developer unit consumption needed for forming one picture element in the developer consumption storing section 39; and a cartridge 21 to accommodate the developer as a developer accommodating body. The developer quantity calculating section 45 has the revising section 38 and the developer consumption calculating section 40.

The substance controlling section 32 sends the image information received from outside to the image controlling section 33; sends a print finish information to the picture element number counting section 36 per sheet; sends a picture element number information in a printable range obtained according to the standard of the sheet to the revising section 38; and presents a developer remainder quantity to user via the displaying section 34 on the basis of the information obtained by referring to the developer quantity storing section 35 recording the developer unit consumption, the developer consumption received from the developer consumption calculating section 40 and the developer quantity stored in the developer quantity storing section 35.

The image controlling section 33 changes the image information received from the substance controlling section 32 into the binary image information, and sends the binary image information to the exposing device 9 and the picture element number counting section 36. The exposing device 9 having received the binary image information, according to the same method stated in the embodiment 1, forms an electrostatic latent image on the surface of the photosensitive body 8 on the basis of the received binary image information. Further, the picture element number counting section 36 having received the binary image information counts the picture element number of the binary image information received into the exposing device 9 from the image controlling section 33 until received the print finish information from the substance controlling section 32, and sends a picture element number counted value per sheet to the revising section 38.

The revising section 38 is informed of the picture element number by the picture element number counting section 36, on the basis of the information, refers to a revision value table stored in the revision value table storing section 37, and sends the revision information obtained by referring to the developer consumption calculating section 40. Further, the developer consumption calculating section 40 having received the revision information refers to the developer unit consumption stored in the developer consumption storing section 39, calculates the developer consumption, and sends the developer consumption to the substance controlling section 32.

Furthermore, the developer consumption calculating section 40 refers to the picture element number counted value per sheet revised in the revising section 38, the developer unit consumption needed for form one picture element and stored in the developer consumption storing section 39, and calculates a developer consumption.

Figure 6:
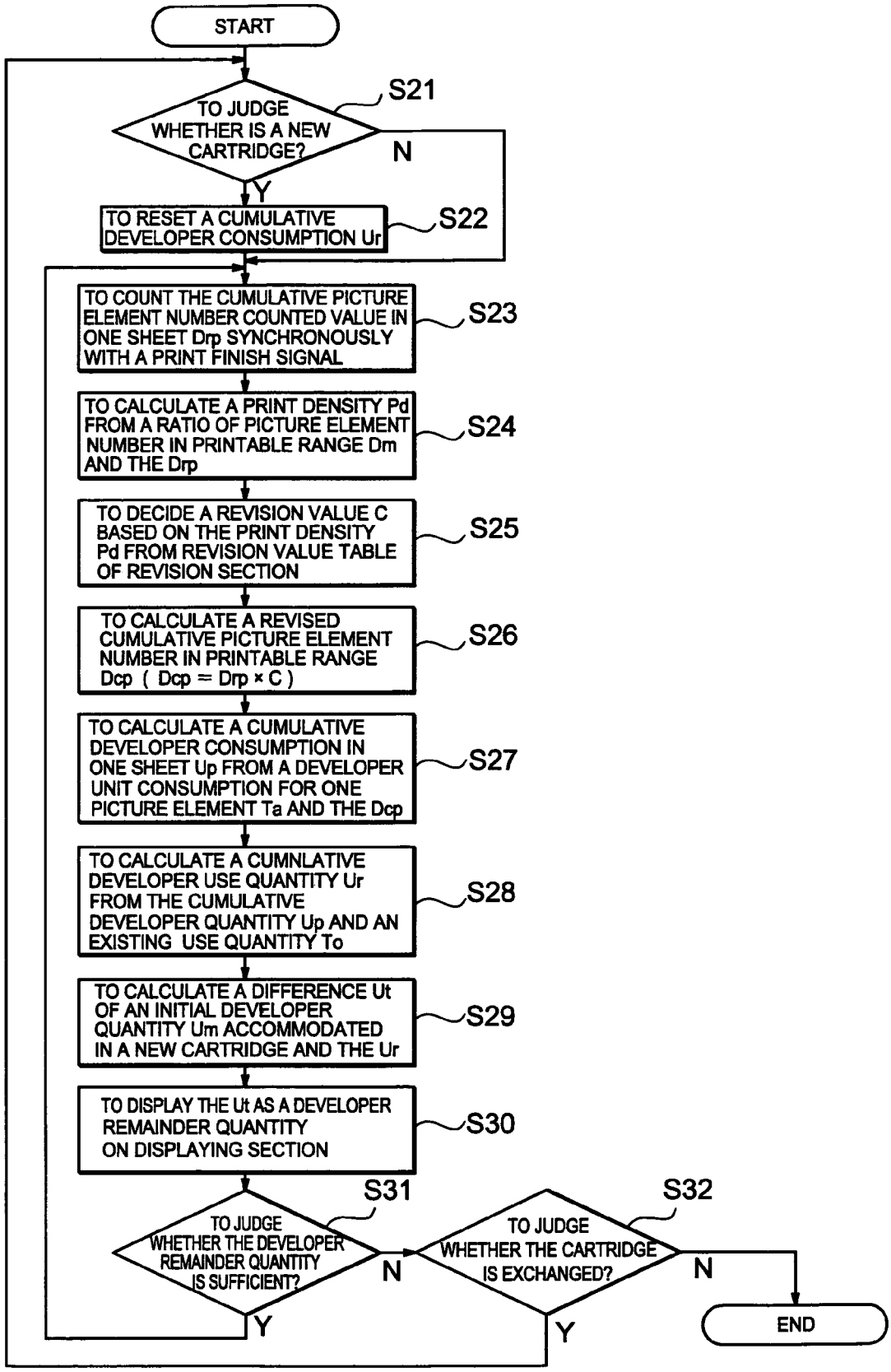
FIG. 6 is a flowchart showing the operation of the image forming apparatus in the embodiment 2 for calculating developer consumption.

FIG. 6 is a flowchart showing the operation of the image forming apparatus in the embodiment 2 for calculating developer consumption. The following is to explain in detail the operations of the image forming apparatus 31 according to the flow chart showed by FIG. 3.

Moreover, in step 21, when the cartridge 21 is judged to not be unused, the substance controlling section 32 does not reset the cumulative developer consumption Ur, but sends image information of an image formed on the sheet 20 to the image controlling section 33. The image controlling section 33, after received the image information, changes the image information into the binary image information, and sends the binary image information to the exposing device 9 and the picture element number counting section 36.

In the case that the substance controlling section 32 receives the image information from an external apparatus, in step 21, the substance controlling section 2 judges whether the cartridge 21 is unused.

If the cartridge 21 is unused, in step 22, the substance controlling section 2 resets a cumulative developer consumption Ur had by itself to an initial value.

Then, in step 23, the picture element number counting section 36 calculates the picture element number Do from the binary image information sent from the image controlling section 33, and counts the picture element number counted value in one page Drp until received the print finish information per sheet from the substance controlling section 32. When received the print finish information from the substance controlling section 32, the picture element number counting section 36 sends the cumulative picture element number counted value in one page Drp to the revising section 38. Further, the substance controlling section 32 calculates a total picture element number Dm in printable area of the selected sheet, and sends the total picture element number Dm to the revising section 38.

Moreover, in the case that an appointed resolution is set to 600 dpi or the like, and a sheet of A4 size is selected, the printable area is an area of 190 mm×270 mm, and the total picture element number Dm in printable area of the selected sheet is calculated as a total picture element number formed in the area of 190 mm×270 mm In step 24, the revising section 38, as a print condition detecting section, calculates a print density Pd of the picture element number in one sheet by using an expression 5 on the basis of the cumulative picture element number counted value in one page Drp sent from the picture element number counting section 36 and the total picture element number Dm sent from the substance controlling section 32.

$$Pd=(Drp\div Dm)\times 100 \qquad \text{Expression 5}$$

Further, in step 25, the revising section 38 decides a revision coefficient C based on the print density Pd from the revision value table stored in the revision value table storing section 37.

Next is to explain a deciding method of the revision coefficient C in detail.

Figure 7:
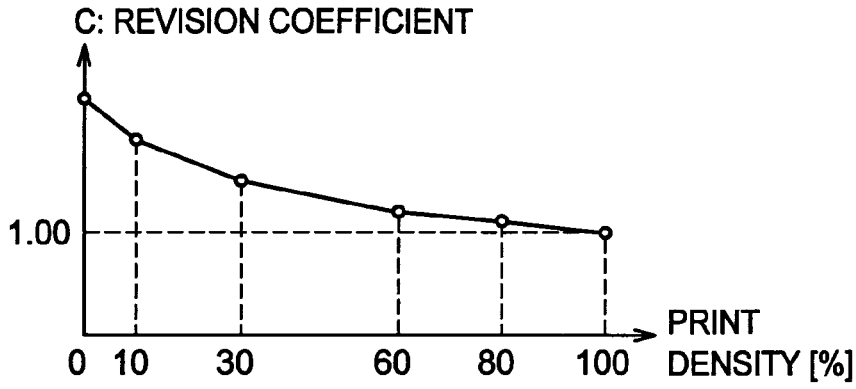
FIG. 7 is a relation diagram showing a relation between revision coefficient C and print density Pd.

FIG. 7 is a relation diagram showing a relation between revision coefficient C and print density Pd. FIG. 7 is plotted by measuring the cumulative picture element number counted value in one page Drp, a developer unit consumption Ta and the cumulative developer consumption in one sheet Up while using the image forming apparatus 1 to respectively form image according to print densities of 0~1%, 2~10%, 11~30%, 31~60%, 61~80%, and 81~100% and by applying these measured values to an expression 6.

$$C=Up\div(Ta\times Drp) \qquad \text{Expression 6}$$

The cumulative developer consumption in one sheet Up is a consumption quantity consumed for printing the picture elements corresponding to the cumulative picture element number counted value in one page Drp.

Moreover, in the embodiment, the print density Pd is an integral number, so its first place behind a decimal point will be rounded up numbers of five and above and be rounded down anything under five. However, it may become more particular, so the revision value table also may be more particular.

TABLE 2

| Print density Pd | Revision coefficient C |
|---|---|
| 0~1 | 1.120 |
| 2~10 | 1.080 |
| 11~30 | 1.040 |
| 31~60 | 1.020 |
| 61~80 | 1.010 |
| 81~100 | 1.001 |

As shown by FIG. 7, in fact, through measuring the cumulative developer consumption in one sheet Up used for printing to correspond to the cumulative picture element number counted value in one page Drp counted by the picture element number counting section 36; through calculating the print density Pd from the total picture element number Dm in printable area of the selected sheet; and through measuring the relation between the cumulative developer consumption in one sheet Up and the print density Pd, different revision coefficients C can be obtained. The revision coefficients C form a revision coefficient function that has a monotonous decreasing tendency (that is, it decreases monotonically).

That is, through previously storing the table 2 made on the basis of the graph in FIG. 7 into the revision value table storing section 37 at the manufacturing stage of the image forming apparatus 31 as revision information, the revising section 38 can refer to the revision value table stored in the revision value table storing section 37 on the basis of the print density Pd outputted from the picture element number counting section 36 in step 25, and can decide the revision coefficient C.

Further, in step 26, in the revising section 38, a revision picture element number counted value Dcp is decided by using the revision coefficient C decided by the revising section 38 and the cumulative picture element number counted value in one page Drp received from the picture element number counting section 36 and by applying these used values to an expression 7, and it is sent to the developer consumption calculating section 40.

$$Dcp=C\times Drp \qquad \text{Expression 7}$$

The revision picture element number counted value Dcp is a picture element number counted value in one page obtained by revising the cumulative picture element number counted value in one page Drp based on the revision coefficient C.

In the case to use an approximate revision expression to indicate the relation of the revision coefficient C and the cumulative picture element number counted value in one page Drp, it is possible to not use the revision value table such as the table 2, but to use an approximate revision expression in the revising section 38 to revise the picture element number counted value Dcp.

In the developer consumption storing section 39, the developer unit consumption Ta is previously stored from the manufacturing stage of the image forming apparatus 31, and an existing use quantity To obtained by adding the use quantity of the developer used for forming image till the current time is also stored. In step 27, the developer consumption calculating section 40 decides the cumulative developer consumption in one sheet Up according to an expression 8.

$$Up=Dcp\times Ta \qquad \text{Expression 8}$$

Further, in step 28, the developer consumption calculating section 40 adds the cumulative developer consumption in one sheet Up to the existing use quantity To to decide a cumulative developer consumption Ur according to an expression 9.

$$Ur=Up+To \qquad \text{Expression 9}$$

Then, the calculated cumulative developer consumption Ur is newly stored in the developer consumption storing section 39, as the existing use quantity To. That is, the existing use quantity To is exchanged whenever the cumulative developer consumption Ur is calculated. Further, the developer consumption Up in one sheet is calculated per page, the cumulative developer consumption Ur is decided.

The cumulative developer consumption Ur decided in the developer consumption calculating section 40 is sent to the substance controlling section 32. In the developer quantity storing section 35, a developer quantity Um previously accommodated in a new cartridge is recorded as an initial developer quantity. In step 29, the substance controlling section 2 having received the cumulative developer consumption Ur refers to the initial developer quantity Um and decides a developer remainder quantity Ut according to an expression 10.

$$Ut=Um-Ur \qquad \text{Expression 10}$$

The developer remainder quantity Ut is a remainder quantity of the developer that is remained in the cartridge 21 and is calculated in the substance controlling section 32 as a developer remainder quantity calculating section from the difference between the initial developer quantity Um previously accommodated in a new cartridge and the cumulative developer consumption Ur calculated by the developer consumption calculating section 40.

The developer remainder quantity Ut calculated by using the above expression 10 is displayed by the displaying section 34 serving as an informing section and is informed to user.

In step 31, the informed user or the image forming apparatus 31 judges whether the developer remainder quantity Ut is sufficient for forming next image when next image information is sent to the image forming apparatus 31. When the developer remainder quantity Ut is judged to be sufficient, the image forming apparatus 31 returns to the step 23, and again executes print. Further, in step 31, when the developer remainder quantity Ut is judged to not be sufficient, the image forming apparatus 31 informs user of an instruction needing to exchange the cartridge 21 into a new cartridge via the displaying section 34.

In the case, as an informing section being conveying means to convey the developer remainder quantity Ut to user, it may be to print the developer remainder quantity Ut on sheet, and it also may be to display the developer remainder quantity Ut on a information terminal connected with the image forming apparatus 1.

In step 32 when the cartridge 21 is judged to be exchanged into a new cartridge by user, the image forming apparatus 31 returns to the step 21, executes print once more. At that time, in the step 21, because the cartridge 21 is a new cartridge, in the step 22, the cumulative developer consumption Ur is reset to an initial values. That is, it is reset whenever the cartridge 21 is exchanged into a new cartridge. Further, in the step 32, if the cartridge 21 is not exchanged, the image forming apparatus 31 finishes the series of processes.

Moreover, after a toner remainder quantity sensor (not shown) detects that the remainder quantity of the cartridge 21 is less than a predetermined value, if the toner remainder quantity sensor further detects that the remainder quantity of the cartridge 21 is more than the predetermined value, the substance controlling section 32 can judge that the cartridge 21 is exchanged.

In the embodiment, the error produced due to the fog is considered, and the cumulative picture element number counted value in one page Drp is revised. However, if because of other reason except the fog, the developer consumption can not be calculated from picture element number in image information, in this case, it is possible to execute a revision with respect to the relation of the cumulative picture element number counted value in one page Drp and the developer unit consumption Ta, and to calculate a correct consumption of the developer.

Further, in the embodiment, the image forming apparatus 1 in which only one photosensitive body 8 and only one exposing device 9 are included is explained in detail. However, with respect to such image forming apparatus comprising plural kinds of developers such as cyan developer, magenta developer, yellow developer and black developer, the picture element number counting section 36 may execute counts of the respective picture element numbers to correspond to the respective developers by using the above-stated method, the revising section 38 may execute revisions to correspond to the respective developers by using the above-stated method, and the developer consumption calculating section 40 may execute calculations of the respective developer remainder quantities Ut to correspond to the respective developers by using the above-stated method.

Further, in the embodiment, the cumulative developer consumption Ur calculated by the developer consumption calculating section 40 is sent to the substance controlling section 32, the developer consumption is cumulatively recorded by the substance controlling section 32, and the developer remainder quantity Ut is calculated in the substance controlling section 32. However, it is possible to provide the cartridge 21 with a memorizing means such as memory element and the like, and to make the memorizing means memorize the cumulative developer consumption Ur as the developer consumption calculated by the developer consumption calculating section 40. Thus, the substance controlling section 32 may refer to the memorizing means to display the developer remainder quantity Ut on the displaying section 34.

In the embodiment, the image forming apparatus 31 changes the received image information into the binary image information, refers to the revision value table previously stored in the revision value table storing section 37 from the relation of the picture element number based on the binary image information and the print density, and revise the developer consumption by using the appointed calculating method. Therefore, it is possible to improve the accuracy of the developer consumption and the developer remainder quantity.

Further, in the embodiment 2, the image forming apparatus 31 is different from the image forming apparatus 1 in the embodiment 1, it does need a print number counting section, so it's structure can be simplified. Furthermore, because the developer remainder quantity Ut is obtained by calculating the cumulative developer consumption Up per printing one sheet, it is possible to further improve the accuracy of the developer consumption and the developer remainder quantity.

Embodiment 3

The following is to explain embodiment 3 in detail with respect to the image forming apparatus of the present invention. The image forming apparatus of the embodiment 3 has some same structure as the image forming apparatus 31 of the embodiment 2, therefore regarding the same detail explanations, they will be omitted.

Figure 8:
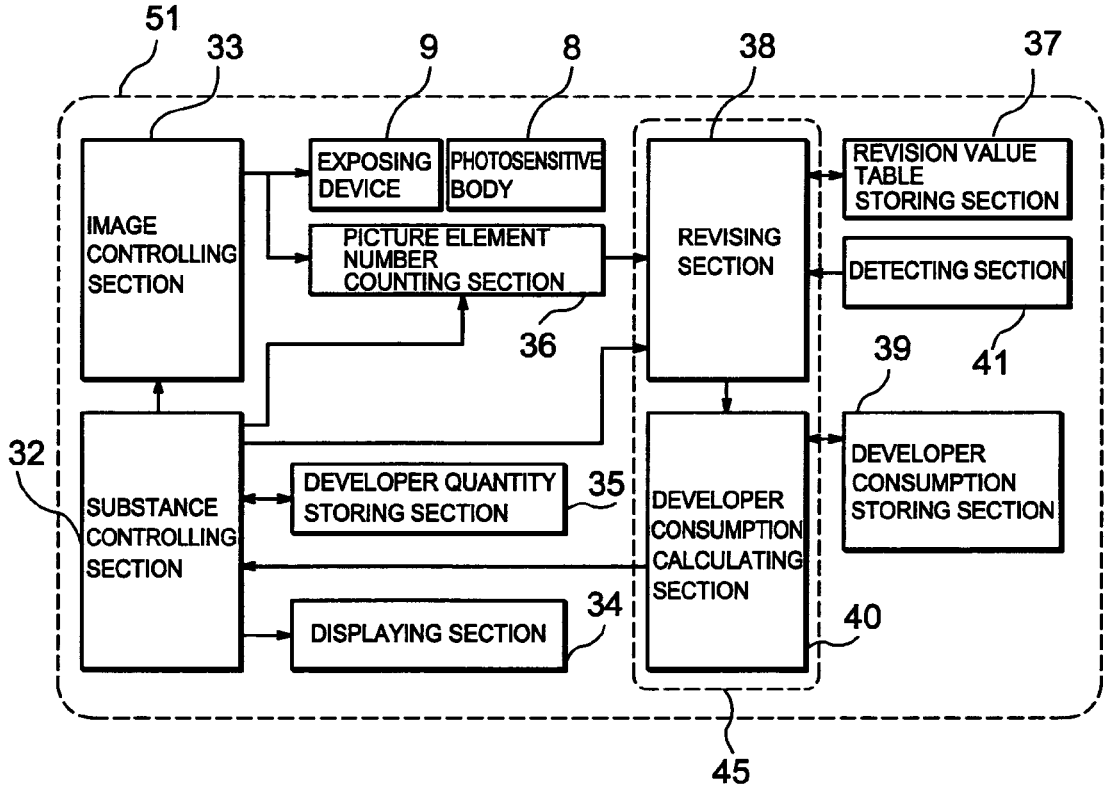
FIG. 8 is a block diagram showing construction of an image forming apparatus according to the embodiment 3.

FIG. 8 is a block diagram showing construction of an image forming apparatus according to the embodiment 3.

In image forming apparatus 51 of the embodiment 3, a detecting section 41 as a detecting means capable of detecting the occurrence reason of fog is formed, it is different from the image forming apparatus 31 in the embodiment 2.

The detecting section 41 is a sensor for detecting condition considered being the occurrence reason of fog, so it is possible to detect a variable which may make print condition change, the print condition may be thickness of the sheet 20, print density based on image information and size of the sheet 20, color information of the developer, use number or life time of the photosensitive body 8, quantity of the developer remaining in the cartridge 21, air temperature and air humidity where the image forming apparatus is placed, or the like. In the embodiment, for simple explanation, such detecting section 41 capable of detecting the thickness of the sheet 20, and the print density based on image information and size of the sheet 20 will be described.

Moreover, though the detail explanation is omitted, when the detecting section detects the color information of the developer, the use number or the life time of the photosensitive body 8, the quantity of the developer remaining in the cartridge 21, the outer air temperature and the outer air humidity where the image forming apparatus is placed, or the inner temperature and the inner humidity, it is possible to obtain the same effect by using the same method stated in the embodiment 3 to make revision information and to previously store it into a revision information storing section. Further, through detecting plural print conditions such as the above stated and using the detecting result, it is possible to calculate a revision coefficient with higher accuracy. Furthermore, it is also possible to detect only one of these print conditions, then to decide a revision coefficient.

Figure 9:
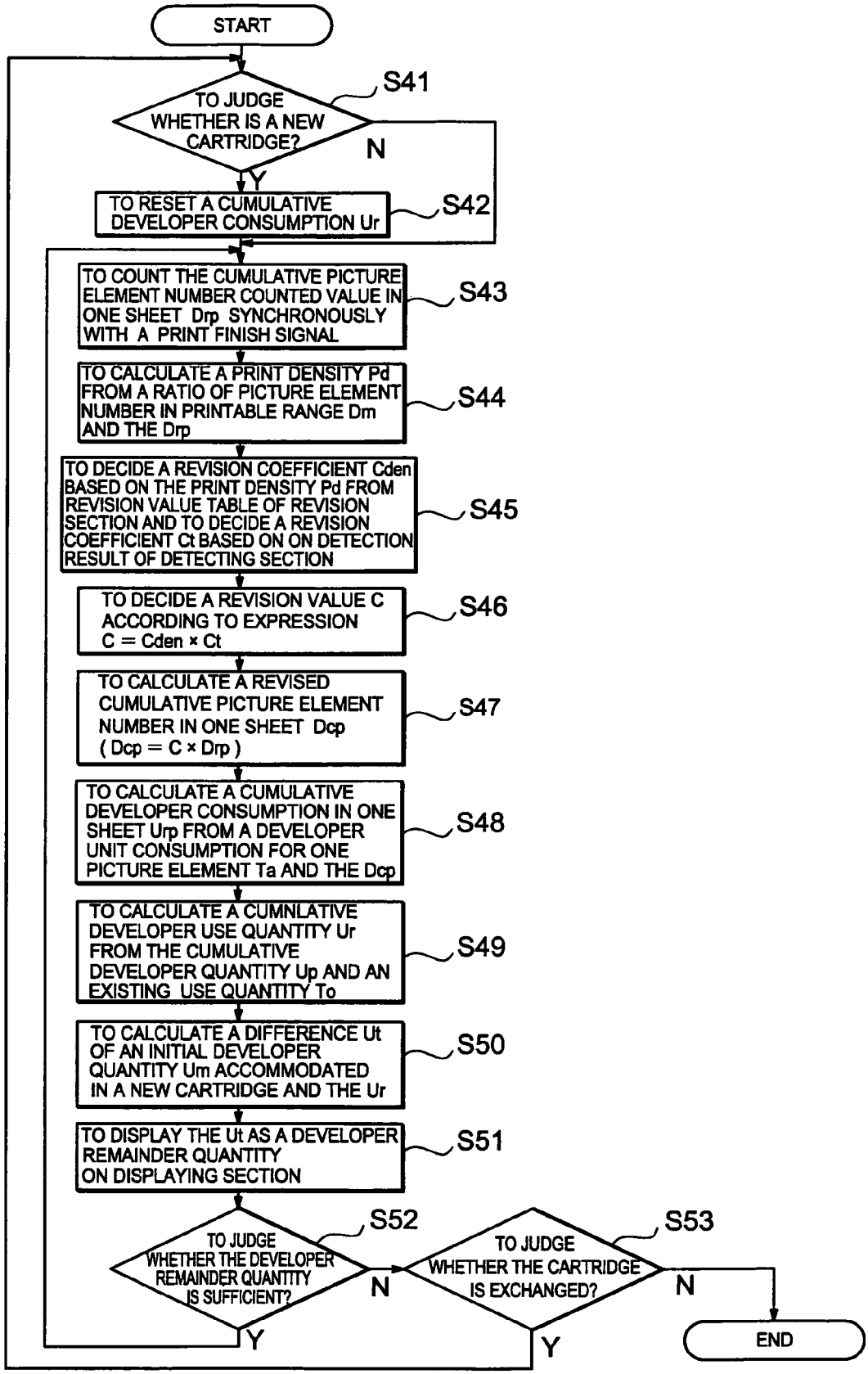
FIG. 9 is a flowchart showing the operation of the image forming apparatus in the embodiment 3 for calculating developer consumption.

FIG. 9 is a flowchart showing the operation of the image forming apparatus in the embodiment 3 for calculating developer consumption. The following is to explain in detail the operations of the image forming apparatus 51 according to the flow chart showed by FIG. 9.

The image forming apparatus 51 calculates the developer consumption according to the flow chart showed by FIG. 9. The substance controlling section 32, when received image information from an external apparatus, in step 41, judges whether the cartridge 21 is unused. If the cartridge 21 is unused, in step 42, the substance controlling section 2 resets a cumulative developer consumption Ur had by itself to an initial value.

Then, in step 43, the picture element number counting section 36 calculates the picture element number Do from the binary image information sent from the image controlling section 33, and counts per page the picture element number counted value in one page Drp till received the print finish information per sheet from the substance controlling section 32. When received the print finish information in the current page from the substance controlling section 32, the picture element number counting section 36 sends the cumulative picture element number counted value in one page Drp to the revising section 38. Further, the substance controlling section 32 calculates a total picture element number Dm in printable area of the selected sheet, and sends the total picture element number Dm to the revising section 38.

In step 44, the revising section 38, as a print condition detecting section, calculates a print density Pd of the picture element number in one sheet by using an expression 5 on the basis of the cumulative picture element number counted value in one page Drp sent from the picture element number counting section 36 and the total picture element number Dm sent from the substance controlling section 32.

$$Pd=(Drp\div Dm)\times 100 \qquad \text{Expression 5}$$

Further, in step 45, the revising section 38 decides a revision coefficient Cden based on the print density Pd from the revision value table stored in the revision value table storing section 37.

Next is to explain a deciding method of the revision coefficient Cden in detail.

Figure 10:
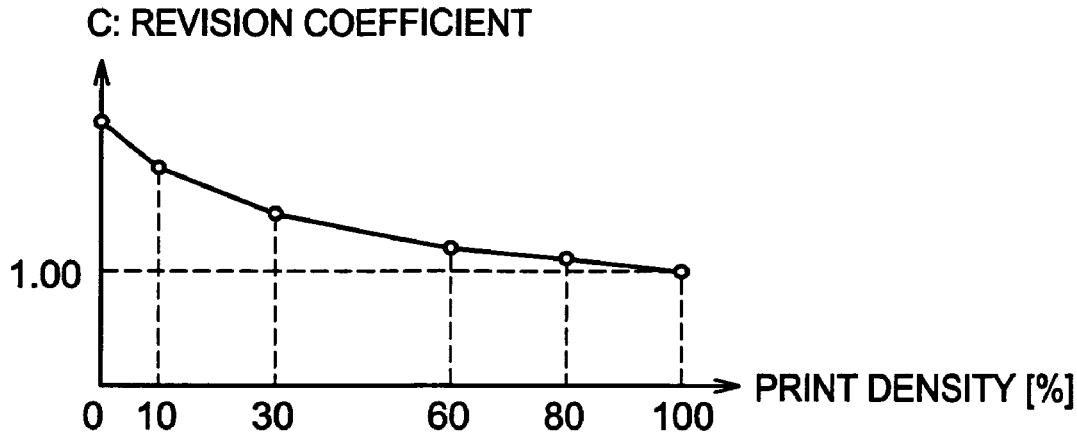
FIG. 10 is a relation diagram showing a relation between revision coefficient Cden and print density Pd.

FIG. 10 is a relation diagram showing a relation between revision coefficient Cden and print density Pd. FIG. 10 is plotted by measuring the cumulative picture element number counted value in one page Drp, a developer unit consumption Ta and the cumulative developer consumption in one sheet Up while using the image forming apparatus 51 to respectively form image according to print densities of 0~1%, 2~10%, 11~30%, 31~60%, 61~80%, and 81~100% and by applying these measured values to an expression 11.

$$Cden=Up\div(Ta\times Drp) \qquad \text{Expression 11}$$

The cumulative developer consumption in one sheet Up is a consumption quantity consumed for printing the picture elements corresponding to the cumulative picture element number counted value in one page Drp.

TABLE 3

| Print density Pd | Revision coefficient Cden |
|---|---|
| 0~1 | 1.120 |
| 2~10 | 1.080 |

TABLE 3-continued

| Print density Pd | Revision coefficient Cden |
|---|---|
| 11~30 | 1.040 |
| 31~60 | 1.020 |
| 61~80 | 1.010 |
| 81~100 | 1.001 |

As shown by FIG. 10, in fact, through measuring the cumulative developer consumption in one sheet Up used for printing to correspond to the cumulative picture element number counted value in one page Drp counted by the picture element number counting section 36; through calculating the print density Pd from the total picture element number Dm in printable area of the selected sheet; and through measuring the relation between the cumulative developer consumption in one sheet Up and the print density Pd, the revision coefficient Cden can be thought it has a monotonous decreasing tendency.

That is, through previously storing the table 3 made on the basis of the graph in FIG. 10 into the revision value table storing section 37 at the manufacturing stage of the image forming apparatus 51 as revision information, the revising section 38 can refer to the revision value table stored in the revision value table storing section 37 on the basis of the print density Pd outputted from the picture element number counting section 36 in step 45, and can decide the revision coefficient Cden.

Then, the detecting section 41, as a print condition detecting section, detects the thickness of the sheet 20. The revision section 38 refers to the revision value table which relates to the relation between the thickness of sheet and the developer consumption and which is previously stored in the revision value table storing section 37 on the basis of the detected thickness, and decides a revision value Ct on the basis of the thickness of the sheet 20 sent per sheet from the picture element number counting section 36.

When the sheet is thinner, the revision value Ct is decided to 1.000. If the image forming apparatus 51 uses five kinds of sheets, and they respectively are thinner, thin, usual, thick and thicker, the revision value Ct is decided on the basis of the print result using these sheets with different thickness.

TABLE 4

| Sheet Thickness | Revision Value Ct |
|---|---|
| Thinner | 1.000 |
| Thin | 1.010 |
| Usual | 1.020 |
| Thick | 1.040 |
| Thicker | 1.060 |

Figure 11:
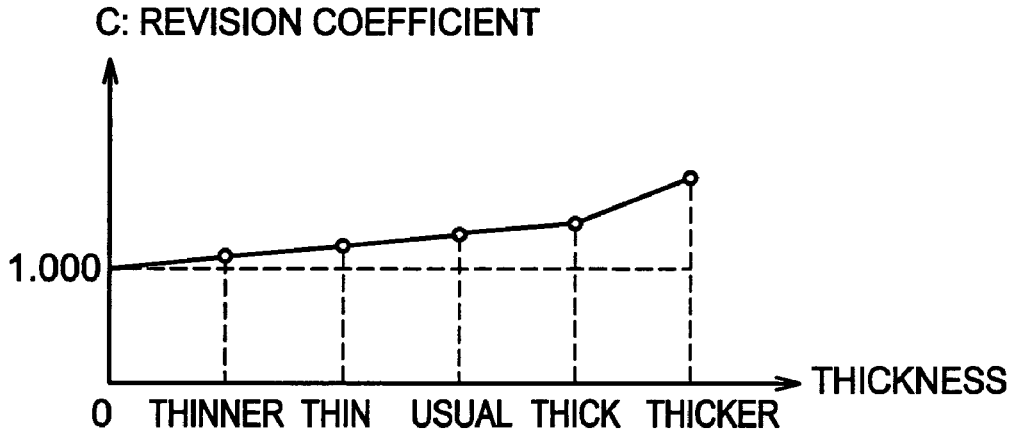
FIG. 11 is a relation diagram showing a relation between revision coefficient Ct and sheet thickness.

In the case, through storing a revision value table made on the basis of FIG. 11 and showed by the table 4 into revision value table storing section 37 as revision information, the revising section 38 can decide the revision value Ct by referring to the revision value table.

Further, in step 46, in the revising section 38, by using the Cden and the Ct decided by the above method, and by using an expression 12, a revision coefficient C is decided.

$$C=Cden\times Ct \qquad \text{Expression 12}$$

In step 47, the revising section 38 decides a revision picture element number counted value Dcp by using the revision coefficient C and the cumulative picture element number counted value in one page Drp and by applying these used values to an expression 13, and sends it to the developer consumption calculating section 40.

$$Dcp=C\times Drp \qquad \text{Expression 13}$$

The revision picture element number counted value Dcp is a picture element number counted value in one page obtained by revising the cumulative picture element number counted value in one page Drp based on the revision coefficient C.

In the case to use an approximate revision expression to indicate the relation of the revision coefficient C and the cumulative picture element number counted value in one page Drp, it is possible to not use the revision value table such as the table 3, but to use an approximate revision expression in the revising section 38 to revise the picture element number counted value Dcp.

In the developer consumption storing section 39, the developer unit consumption Ta is previously stored from the manufacturing stage of the image forming apparatus 51, and an existing use quantity To obtained by adding the use quantity of the developer used for forming image till the current time is also stored. In step 48, the developer consumption calculating section 40 decides the cumulative developer consumption in one sheet Up according to an expression 8.

$$Up=Dcp\times Ta \qquad \text{Expression 8}$$

Further, in step 49, the developer consumption calculating section 40 adds the cumulative developer consumption in one sheet Up to the existing use quantity To to decide a cumulative developer consumption Ur according to an expression 9.

$$Ur=Up+To \qquad \text{Expression 9}$$

Then, the calculated cumulative developer consumption Ur is newly stored in the developer consumption storing section 39 as the existing use quantity To. That is, the existing use quantity To is exchanged whenever the cumulative developer consumption Ur is calculated. Further, the developer consumption Up in one sheet is calculated per page, the cumulative developer consumption Ur is decided.

The cumulative developer consumption Ur decided in the developer consumption calculating section 40 is sent to the substance controlling section 32. In the developer quantity storing section 35, a developer quantity Um previously accommodated in a new cartridge is recorded as an initial developer quantity. In step 50, the substance controlling section 2 having received the cumulative developer consumption Ur refers to the initial developer quantity Um and decides a developer remainder quantity Ut according to an expression 10.

$$Ut=Um-Ur \qquad \text{Expression 10}$$

The developer remainder quantity Ut is a remainder quantity of the developer that is remained in the cartridge 21 and is calculated in the substance controlling section 32 as a developer remainder quantity calculating section from the difference between the initial developer quantity Um previously accommodated in a new cartridge and the cumulative developer consumption Ur calculated by the developer consumption calculating section 40.

The developer remainder quantity Ut calculated by using the above expression 10 is displayed by the displaying section 34 serving as an informing section and is informed to user in step 51.

In step 52, the informed user or the image forming apparatus 51 judges whether the developer remainder quantity Ut is sufficient for forming next image when next image information is sent to the image forming apparatus 51. When the developer remainder quantity Ut is judged to be sufficient, the image forming apparatus 51 returns to the step 43, and again executes print. Further, in step 52, when the developer remainder quantity Ut is judged to not be sufficient, the image forming apparatus 51 informs user of an instruction needing to exchange the cartridge 21 into a new cartridge via the displaying section 34.

In the case, as an informing section being conveying means to convey the developer remainder quantity Ut to user, it may be to print the developer remainder quantity Ut on sheet, and it also may be to display the developer remainder quantity Ut on a information terminal connected with the image forming apparatus 51.

In step 53, when the cartridge 21 is judged to be exchanged into a new cartridge by user, the image forming apparatus 51 returns to the step 41, executes print once more. At that time, in the step 41, because the cartridge 21 is a new cartridge, in the step 42, the cumulative developer consumption Ur is reset to an initial values. That is, it is reset whenever the cartridge 21 is exchanged into a new cartridge. Further, in the step 53, if the cartridge 21 is not exchanged, the image forming apparatus 51 finishes the series of processes.

Moreover, after a toner remainder quantity sensor (not shown) detects that the remainder quantity of the cartridge 21 is less than a predetermined value, if the toner remainder quantity sensor further detects that the remainder quantity of the cartridge 21 is more than the predetermined value, the substance controlling section 32 can judge that the cartridge 21 is exchanged.

In the embodiment, the error produced due to the fog is considered, and the cumulative picture element number counted value in one page Drp is revised. However, if because of other reason except the fog, the developer consumption can not be calculated from picture element number in image information, in this case, it is possible to execute a revision with respect to the relation of the cumulative picture element number counted value in one page Drp and the developer unit consumption Ta, and to calculate a correct consumption of the developer.

Further, in the embodiment, the image forming apparatus 1 in which only one photosensitive body 8 and only one exposing device 9 are included is explained in detail. However, with respect to such image forming apparatus comprising plural kinds of developers such as cyan developer, magenta developer, yellow developer and black developer, the picture element number counting section 36 may execute counts of the respective picture element numbers to correspond to the respective developers by using the above-stated method, the revising section 38 may execute revisions to correspond to the respective developers by using the above-stated method, and the developer consumption calculating section 40 may execute calculations of the respective developer remainder quantities Ut to correspond to the respective developers by using the above-stated method.

Further, in the embodiment, the cumulative developer consumption Ur calculated by the developer consumption calculating section 40 is sent to the substance controlling section 32, the developer consumption is cumulatively recorded by the substance controlling section 32, and the developer remainder quantity Ut is calculated in the substance controlling section 32. However, it is possible to provide the cartridge 21 with a memorizing means such as memory element and the like, and to make the memorizing means memorize the cumulative developer consumption Ur as the developer consumption calculated by the developer consumption calculating section 40. Thus, the substance controlling section 32 may refer to the memorizing means to display the developer remainder quantity Ut on the displaying section 34.

In the embodiment, the image forming apparatus 51 changes the received image information into the binary image information, refers to the revision value table as second revision information previously stored in the revision value table storing section 37 from the relation of the picture element number based on the binary image information and the print density, further refers to the revision value table as third revision information previously stored in the revision value table storing section 37 from the relation of the thickness of record medium 20 detected by the detecting section 41, and revise the developer consumption by using the appointed calculating method. Therefore, it is possible to improve the accuracy of the developer consumption and the developer remainder quantity that are calculated by the image forming apparatus 51.

The present invention is not limited to the foregoing embodiments but many modifications and variations are possible within the spirit and scope of the appended claims of the invention.

What is claimed is:

1. An image forming apparatus which changes inputted image information into binary image information, exposes a photosensitive body on the basis of said binary image information, and forms a developer image on record medium, comprising:

an exposure picture element number counting section for counting a number of exposed picture elements represented by said binary image information;

a print condition detecting section for detecting a predetermined print condition;

a revision information storing section for storing revision information on the basis of said print condition; and a developer quantity calculating section for calculating a developer consumption on the basis of said exposed picture element number counted by said exposure picture element number counting section, said print condition detected by said print condition detecting section, and said revision information stored in said revision information storing section, said developer quantity calculating section including a revising section to revise said exposed picture element number counted by said exposure picture element number counting section into a revised picture element number on the basis of said print condition detected by said print condition detecting section and said revision information stored in said revision information storing section, and a developer consumption calculating section to calculate the developer consumption on the basis of said revised picture element number, wherein said print condition includes a density of said exposed picture elements represented by said binary image information;

wherein said print condition detecting section calculates said density of said exposed picture elements;

wherein said revision information stored by said revision information storing section includes information that was previously calculated on the basis of said density of said exposed picture elements represented by said binary image information; and wherein said revising section revises said exposed picture element number counted by said exposure picture element number counting section into said revised picture element number based at least in part on said density of said exposed picture elements represented by said binary image information, which is obtained by said print condition detecting section, and said revision information stored in said revision information storing section, said revised picture element number becoming smaller, for any given value of said exposed picture number, as said density of said exposed picture elements rises.

2. The image forming apparatus according to claim 1, further comprising a developer consumption storing section to store a developer unit consumption needed for one unit picture element, wherein said developer consumption calculating section calculates said developer consumption on the basis of said developer unit consumption and said revised picture element number.

3. The image forming apparatus according to claim 1, further comprising a developer quantity storing section to store an initial developer quantity; and wherein said developer consumption calculating section calculates said developer consumption based on said initial developer quantity.

4. The image forming apparatus according to claim 1, further comprising:

a developer accommodating body; and a informing section for displaying a developer remainder quantity.

5. The image forming apparatus according to claim 1, wherein said information that was previously calculated on the basis of said density of said exposed picture elements is formed from plural revision coefficients respectively corresponding to a plurality of said densities of said exposed picture elements, and said revising section multiplies said exposed picture element number by one of said revision coefficients to produce said revised picture element number, and wherein the smaller said density of said exposed picture elements is, the larger one of said revision coefficients is.

6. The image forming apparatus according to claim 5, wherein the density of said exposed picture elements is a print density calculated as (Drp/Dm)×100, where Drp is a cumulative picture element number count value in a predetermined area of a recording medium, and Dm is a total picture element number in a printable range of the predetermined area.

7. The image forming apparatus according to claim 1, wherein said print condition includes a thickness of a record medium;

said print condition detecting section detects said thickness of said record medium;

said revision information stored in said revision information storing section includes information that was previously calculated on the basis of said thickness of said record medium; and said revising section revises said exposed picture element number counted by said exposure picture element number counting section into said revised picture element number based at least in part on said thickness of said record medium, which is obtained by said print condition detecting section, and on the basis of said revision information stored in said revision information storing section.

8. The image forming apparatus according to claim 7, wherein said information that was previously calculated on the basis of said thickness of said recording medium is formed from plural revision coefficients respectively corresponding a plurality of thicknesses of said record medium, and said revising section multiplies said exposed picture element number by said revision coefficient to produce said revision picture element number.

9. The image forming apparatus according to claim 1, wherein said print condition includes a kind of said developer;

said print condition detecting section detects said kind of said developer;

said information stored in said revision information storing section includes information which was previously calculated on the basis kinds of said developer; and said revising section revises said exposed picture element number counted by said exposure picture element number counting section into said revised picture element number based at least in part on said kind of said developer, which is obtained by said print condition detecting section, and on the basis of said revision information stored in said revision information storing section.

10. The image forming apparatus according to claim 1, further comprising a photosensitive body, and wherein said print condition includes a cumulative use quantity of developer used by said photosensitive body;

said print condition detecting section detects said cumulative use quantity of developer used by said photosensitive body;

said revision information stored by said revision information storing section includes information which was previously calculated on the basis of said cumulative use quantities; and said revising section revises said exposed picture element number counted by said exposure picture element number counting section into said revised picture element number based at least in part on said cumulative use quantity used by said photosensitive body, which is obtained by said print condition detecting section, and on the basis of said revision information stored in said revision information storing section.

11. The image forming apparatus according to claim 1, wherein said print condition includes a temperature or humidity where said image forming apparatus is placed;

said print condition detecting section detects said temperature or humidity;

said revision information stored in said revision information storing section includes information which was previously calculated on the basis of said temperature or humidity; and said revising section revises said exposed picture element number counted by said exposure picture element number counting section into said revised picture element number based at least in part on said temperature or humidity, which is obtained by said print condition detecting section, and on the basis of said revision information stored in said revision information storing section.

12. The image forming apparatus according to claim 1, wherein the density of said exposed picture elements is a print density calculated as (Drp/Dm)×100, where Drp is a cumulative picture element number count value in a predetermined area of a recording medium, and Dm is a total picture element number in a printable range of the predetermined area.

13. An image forming apparatus, comprising:

an image carrying body;

an exposing section for forming a latent image on the image carrying body;

a developer accommodating body which accommodates developer, developer from the developer accommodating body adhering to the latent image formed on the image carrying body so as to form a developer image;

an exposure picture element number counting section which produces a picture element number by counting a number of picture elements exposed by the exposing section;

a print condition detecting section which detects a picture element density of the exposed picture elements;

a revision information storing section which stores revision information for different picture element densities;

a revision section which revises the picture element number counted by said exposure picture element number counting section into a revised picture element number based at least in part on revision information corresponding to the picture element density detected by the print condition detecting section; and a developer consumption calculating section which calculates a developer consumption of consumed developer on the basis of said revised picture element number, wherein the revision information is used by said revision section to make the revised picture element number become larger, with respect to any particular picture element number of the exposed picture elements, as the picture element density decreases.

14. The image forming apparatus according to claim 13, wherein the revision information includes a plurality of revision coefficients respectively corresponding to different picture element densities; wherein the revision section multiplies the picture element number of the exposed picture elements by one of the revision coefficient so as to revise the picture element number into the revised picture element number; and wherein the smaller the picture element density is, the larger the revision coefficient is.

15. The image forming apparatus according to claim 14, wherein the density of said exposed picture elements is a print density calculated as (Drp/Dm)×100, where Drp is a cumulative picture element number count value in a predetermined area of a recording medium, and Dm is a total picture element number in a printable range of the predetermined area.

16. The image forming apparatus according to claim 13, wherein the density of said exposed picture elements is a print density calculated as (Drp/Dm)×100, where Drp is a cumulative picture element number count value in a predetermined area of a recording medium, and Dm is a total picture element number in a printable range of the predetermined area.

17. An image forming apparatus, comprising:

an image carrying body;

an exposing section for exposing picture elements on the image carrying body to form a latent image;

a developer accommodating body which accommodates developer, developer from the developer accommodating body adhering to the latent image formed on the image carrying body so as to form a developed image;

an exposure picture element number counting section which provides an exposed picture element number by counting a number of picture elements exposed by the exposing section;

a print condition detecting section which detects a density of the exposed picture elements;

a revision information storing section which stores revision information, the revision information including revision coefficients for different picture element densities, the revision coefficients being specified by a revision coefficient function that decreases monotonically as the picture element density increases;

a revision section which generates a revised picture element number as a function of the picture element density detected by the print condition detecting section and a revision coefficient corresponding to the picture element density detected by the print condition detecting section; and a developer consumption calculating section which calculates a developer consumption on the basis of said revised picture element number.

18. The image forming apparatus according to claim 17, wherein the density of said exposed picture elements is a print density calculated as a constant times (Drp/Dm), where Drp is a cumulative picture element number count value in a predetermined area of a recording medium, and Dm is a total picture element number in a printable range of the predetermined area.

* * * * *